United States Patent [19]

Kikuchi et al.

[11] Patent Number: 4,805,578

[45] Date of Patent: Feb. 21, 1989

[54] AIR-FUEL RATIO CONTROL SYSTEM FOR INTERNAL COMBUSTION ENGINE

[75] Inventors: Toshiaki Kikuchi; Masumi Kinugawa, both of Okazaki; Kenichirou Kamai, Kariya, all of Japan

[73] Assignee: Nippondenso Co., Ltd., Kariya, Japan

[21] Appl. No.: 111,289

[22] Filed: Oct. 22, 1987

[30] Foreign Application Priority Data

Oct. 27, 1986 [JP] Japan ..... 61-255215

[51] Int. Cl.[4] ..... F02D 41/14; F02D 41/16

[52] U.S. Cl. ..... 123/489; 123/339

[58] Field of Search ..... 123/339, 440, 489

[56] References Cited

U.S. PATENT DOCUMENTS 3,831,564 8/1974 Schmidt et al. .

4,508,075 4/1985 Takao et al. ..... 123/440 X 4,708,109 11/1987 Takao ..... 123/339

FOREIGN PATENT DOCUMENTS 217745 12/1983 Japan .

*Primary Examiner*—Tony M. Argenbright

*Attorney, Agent, or Firm*—Cushman, Darby & Cushman

[57] ABSTRACT

An air-fuel ratio control system realized with a computer for an internal combustion engine is disclosed, wherein an idle discriminator unit discriminates whether the internal combustion engine is idle or not, and when it is idle, an idle air-fuel ratio compensation amount determining unit decides an air-fuel ratio compensation amount in accordance with an output of an air-fuel ratio detector. When the engine is not idle, on the other hand, a non-idle air-fuel ratio compensation amount determining unit decides an air-fuel ratio compensation amount. The idle air-fuel ratio compensation amount determining unit includes a rich-lean discriminator unit for discriminating whether the air-fuel ratio is on lean or rich side in accordance with the output of the idle discriminator unit, a skip unit for skipping the air-fuel ratio compensation amount to a greater degree than in non-idle state when the rich-lean discriminator unit decides that the air-fuel ratio has shifted from lean to rich side or the opposite way, a hold unit for holding the compensation amount after skip for a predetermined length of time, and an integrator for integrating the compensation amount upon the lapse of the predetermined length of time.

15 Claims, 8 Drawing Sheets

K2=(O2 F.B. COMPENSATION) WAVEFORM

OFF-IDLE STATE

ON-IDLE STATE (A) O2 SENSOR OUTPUT SIGNAL (B) A/F F.B. CONTROL SIGNAL

AIR-FUEL RATIO CONTROL SYSTEM FOR INTERNAL COMBUSTION ENGINE

BACKGROUND OF THE INVENTION

1. Field of the Invention

The present invention relates to system for controlling the air-fuel ratio of an internal combustion engine, or more in particular to an air-fuel ratio control system suitably used with an internal combustion engine for automobiles equipped with exhaust gas purification means including an air-fuel ratio sensor and a three-way catalyst.

2. Description of the Related Art

An air-fuel ratio feedback (F.B.) control using an oxygen gas sensor is practically used as a conventional means against exhaust gas. Such a control system greatly improves the accuracy of the air-fuel ratio control. However the speed of the internal combustion engine fluctuates in synchronism with the cycles of change in the compensation of the feedback control at the time of engine idling, thus causing an uncomfortable feeling to the driver. To obviate this problem, a prior art control system (such as disclosed in JP-A-58-217745) has been designed to stop the integrating processing of the compensation amount and holding the compensation amount at a predetermined value for a predetermined period of time when the internal combustion engine shifts to idling state.

The above-mentioned conventional method of control, however, is so constructed that the compensation amount is skipped upward from a small value in the non-idle state, the resulting compensation amount is held for a predetermined time, the compensation amount is then increased stepwise little by little, and when the air-fuel ratio shifts from lean to rich side, the compensation amount is reduced slightly and is held for a predetermined length of time. As a consequence, the air-fuel ratio tends to be on lean side, thereby making it impossible to control the air-fuel ratio properly

SUMMARY OF THE INVENTION

Accordingly, the object of the present invention is to provide an air-fuel ratio control system satisfying the requirements of both high accuracy in air-fuel ratio control and stability in idling operation.

According to the present invention, there is provided an air-fuel ratio control system for an internal combustion engine, comprising means for detecting the air-fuel ratio of the internal combustion engine, an idle-state discriminator means for discriminating whether the internal combustion engine is in idle state or not, means for determining the amount of compensation of the air-fuel ratio in accordance with the output of the air-fuel ratio detector means when the idle-state discriminator means discriminates an idle state from another state, means for determining the amount of compensation of the air-fuel ratio under non-idle state in accordance with the output of the air-fuel detector means when the idle-state discriminator means discriminates a non-idle state from an idle state, and means for controlling by feedback the air-fuel ratio of the internal combustion engine in accordance with the amount of air-fuel ratio compensation determined by the means for determining the amount of air-fuel ratio compensation, wherein the idle air-fuel ratio compensation amount determining means rich-lean discriminator means for discriminating whether the air-fuel ratio is on lean or rich side in accordance with the output of the idle-state discriminator means, skip means for skipping the amount of air-fuel ratio compensation considerably as compared with non-idle state when the rich-lean discriminator means discriminates whether the air-fuel ratio is on lean or rich side, hold means for holding the compensation amount for a predetermined length of time after the skip, and integrator means for integrating the compensation amount after the lapse of the predetermined length of time.

In the idle air-fuel ratio compensation amount determining means configured as above, the rich-lean discriminator means discriminates whether the air-fuel ratio is on rich or lean side in accordance with the output of the idle-state discriminator means, and when the rich-lean discriminator means discriminates whether the air-fuel ratio is on lean or rich side, the skip means causes a considerable skip of the air-fuel ratio skip compensation amount as compared with under non-idle state thereby to effect a provisional compensation. The compensation amount after the skip is held for a predetermined length of time by the hold means, and after the lapse of a predetermined period of time, the compensation amount is integrated by the integrator means thereby to reduce the variations in the compensation amount. On the basis of the resulting compensation amount, the air-fuel ratio of the internal combustion engine is subjected to feedback control through the air-fuel ratio feedback control means.

DESCRIPTION OF THE PREFERRED EMBODIMENTS

An embodiment of the present invention will be explained below with reference to the drawings.

Figure 1:
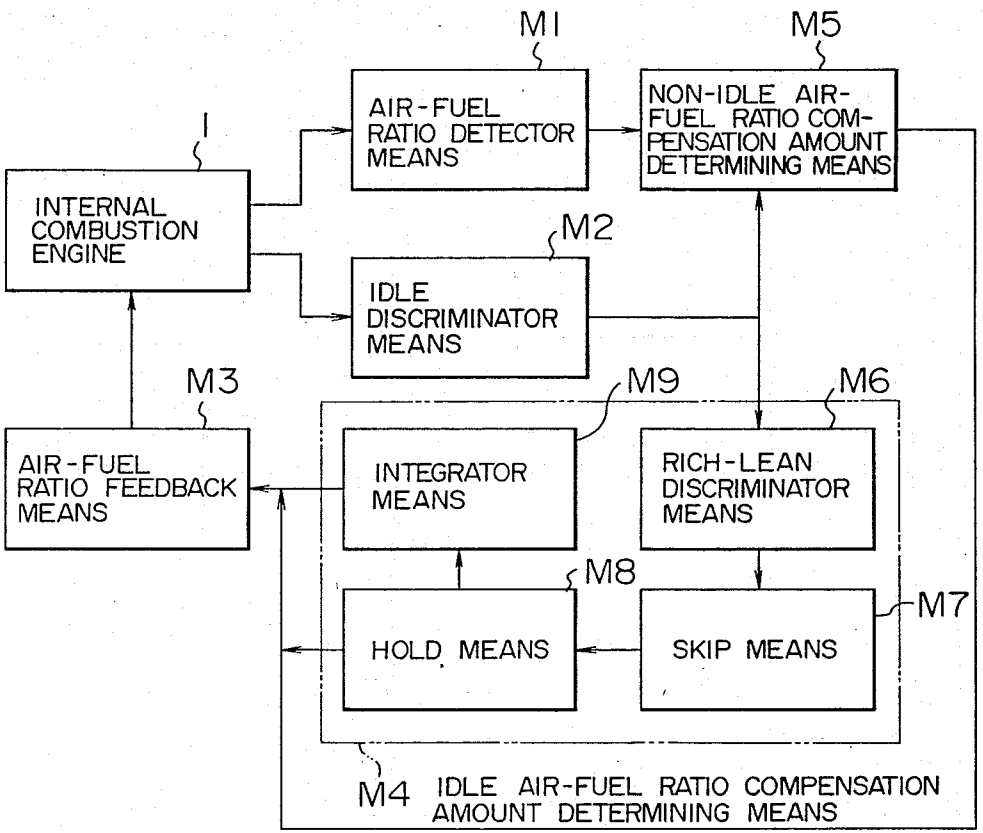
FIG. 1 is a block diagram showing an air-fuel ratio control system according to the present invention in functional blocks.

FIG. 1 is a functional block diagram showing an air-fuel ratio control system for an internal combustion engine according to the present invention. The air-fuel ratio control system according to the present invention, which is realized in software fashion by use of a microcomputer as described later, has a configuration shown functionaly, in FIG. 1.

In FIG. 1, reference numeral 1 designates an internal combustion engine making up an object of control, reference character M1 air-fuel ratio detector means for detecting the air-fuel ratio of the internal combustion engine, M2 an idle-state discriminator means for discriminating whether the internal combustion engine is in an idle state or not, and M3 air-fuel ratio feedback means which is an actuator for subjecting the air-fuel ratio of the internal combustion engine to feedback control by a control signal. According to the present invention, a highly accurate air-fuel ratio control is possible even under an idle state, and for this purpose, the amount of air-fuel ratio compensation is determined separately under idle and non-idle states. In order to realize this function, the control system comprises an idle air-fuel ratio compensation amount determining means M4 and non-idle air-fuel ratio compensation amount determining means M5. In accordance with the output result of the idle discriminator means M2, the idle air-fuel ratio compensation amount determining means M4 or the non-idle air-fuel ratio compensation amount determining means M5 is actuated, and a control signal is applied to the air-fuel ratio feedback means M3. The idle air-fuel ratio compensation amount determining means M4 includes a rich-lean discriminator means M6 for discriminating whether the air-fuel ratio is on lean or rich side in accordance with the output of the idle discriminator means M2 skip means M7 for skipping the air-fuel ratio compensation amount considerably greatly as compared with the non-idel state when the rich-lean discriminator means M6 discriminates whether the air-fuel ratio is on the lean or rich side, hold means M8 for holding the compensation amount for a predetermined length of time after the skip, and integrator means M9 for integrating the compensation amount after the lapse of the predetermined length of time. A specific configuration and operation of the aforementioned air-fuel ratio control system are described below.

Figure 2:
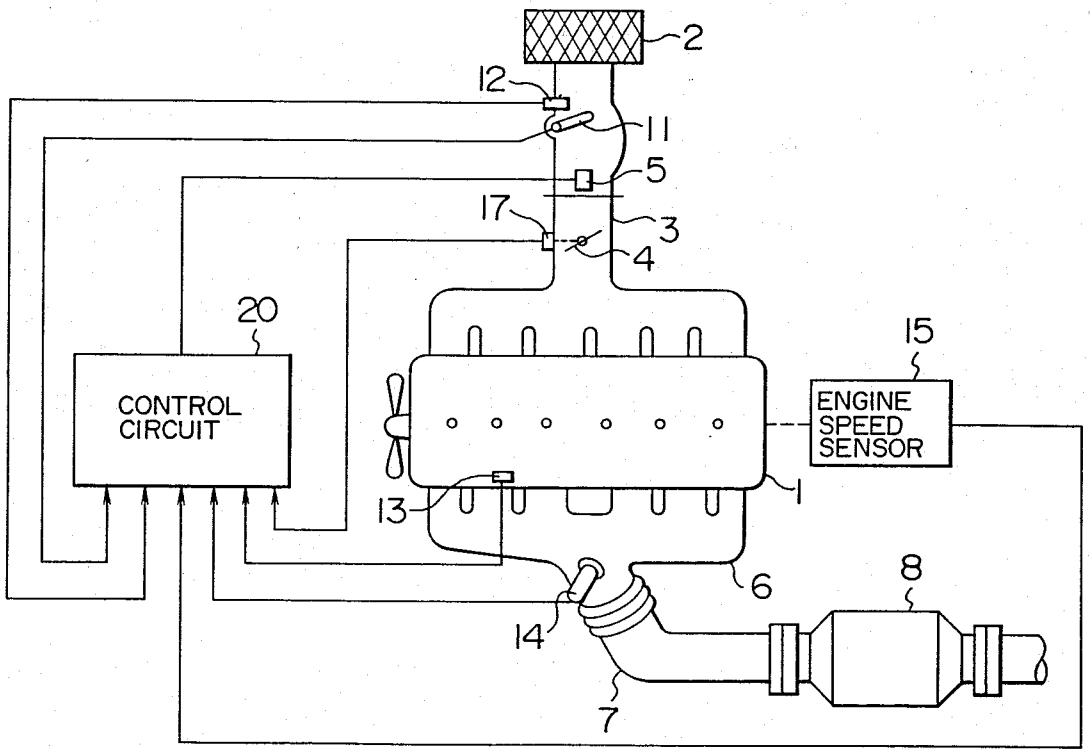
FIG. 2 is a diagram showing a configuration of an embodiment of the present invention.

A specific configuration of an embodiment of the present invention is shown in FIG. 2. The internal combustion engine 1 is a well-known 4-cycle 6-cylinder spark ignition engine for automotive use, in which the combustion air is introduced through an air cleaner 2, an intake pipe 3 and a throttle valve 4. On the other hand, fuel is supplied to each cylinder from a fuel system not shown through a single electromagnetic fuel injection valve 5 mounted on the intake pipe 3 upstream of the throttle valve 4. The exhaust gas produced by combustion is discharged into the atmosphere through an exhaust manifold 6, an exhaust pipe 7, a three-way catalyst converter 8, etc. The intake pipe 3 is provided with an intake amount sensor 11 of potentiometer type for detecting the amount of air taken into the engine 1 and producing an analog voltage corresponding to the intake amount and an intake air temperature sensor 12 of the thermistor or type of detecting the temperature of the air introduced into the engine 1 and producing an analog voltage (analog detection signal) corresponding to the intake air temperature. The engine 1 includes a water temperature sensor 13 of the thermistor type for detecting the temperature of the cooling water and producing an analog voltage (analog detection signal) corresponding to the cooling water temperature. Further, the exhaust manifold 6 includes an oxygen sensor 14 for detecting the air-fuel ratio from the oxygen concentration of the exhaust gas and producing a voltage of about one volt (high level) when the air-fuel ratio is lower than a stoichiometric air-fuel ratio (on the rich side) and a voltage of about 0.1 volt (low level) when the air-fuel ratio is higher than the stoichiometric value (on lean side). An engine speed sensor 15 is for detecting the speed of rotation of the crankshaft of the engine 1 and producing a pulse signal of a frequency corresponding to the engine speed. This engine speed sensor 15 is preferably provided by an ignition coil of an ignition system, in which case the ignition pulse signal from the primary terminal of the ignition coil is used as an engine speed signal. Also, there is provided an idle switch 17 which is adapted to turn on when the throttle valve 4 is closed up. A control circuit 20 is for computing the amount of fuel injection on the basis of detection signals of the sensors 11, 15 and 17 thereby to control the open time of the electromagnetic fuel injection valve 5 and thus adjust the amount of fuel injected.

Figure 3:
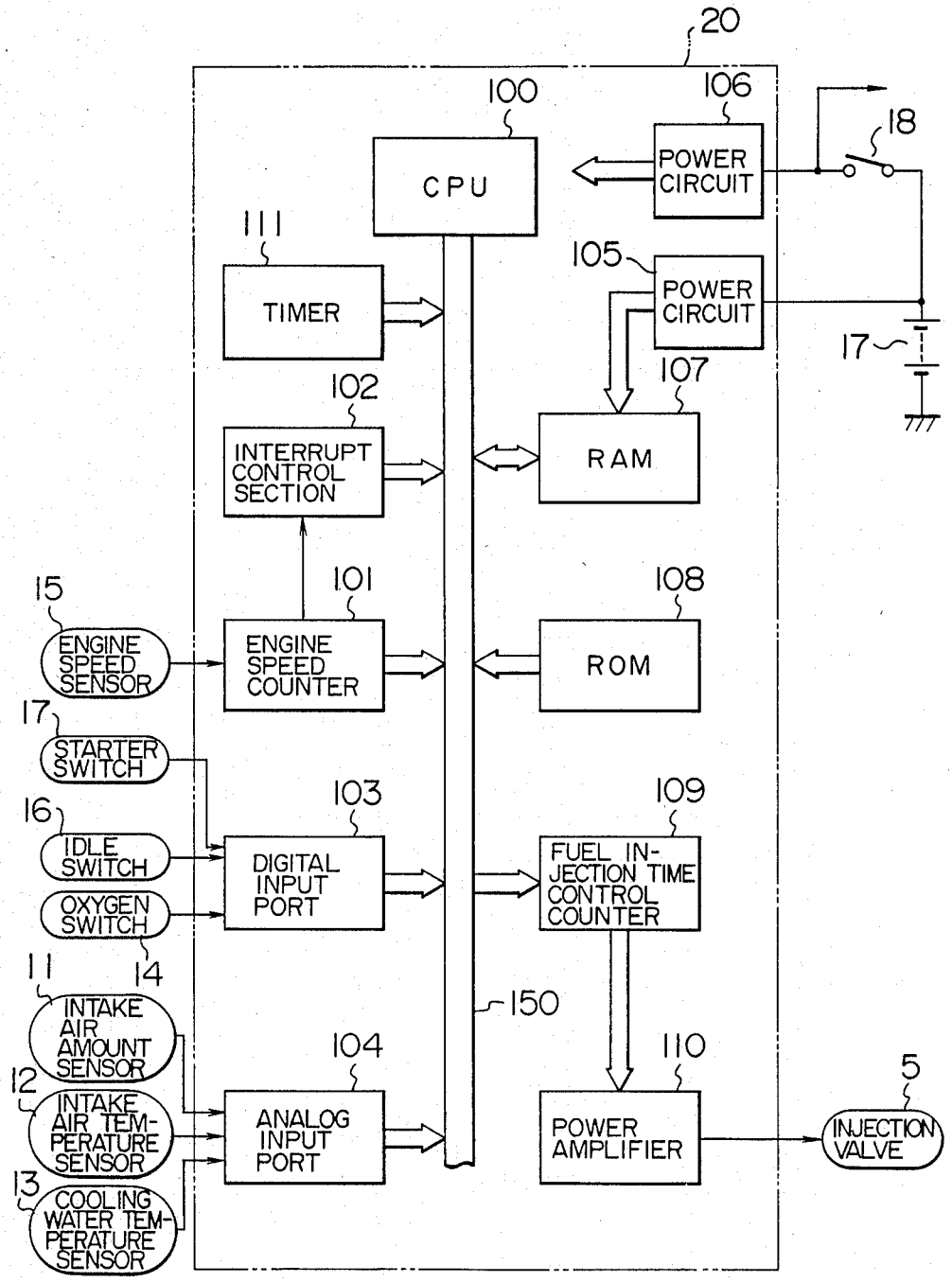
FIG. 3 is an internal block diagram specifically showing a control circuit

The control circuit 20 will be described with reference to FIG. 3. Numeral 100 designates a microprocessor (CPU) for computing the amount of fuel injection, and numeral 101 a number of r.p.m. counter for counting the number of engine r.p.m. in response to a signal from an engine speed (number of r.p.m.) sensor 15. The engine speed counter 101 applies an interrupt command signal to an interrupt control section 102 in synchronism with the engine revolutions. The interrupt control section 102, upon receipt of this signal, applies an interrupt signal to the microprocessor (CPU) 100 through a common bus 150. Numeral 103 designates a digital input port, which shapes the waveform of digital signals such as a signal of the oxygen sensor 14 and idle switch 17 and the starter signal from a starter switch 16 for turning on and off the operation of a starter not shown, and applies the resultant shaped signal to the microprocessor 100. Numeral 104 designates an analog input port including an analog multiplexer and an A/D converter for subjecting signals from the intake air amount sensor 11, intake air temperature sensor 12 and the cooling water temperature sensor 13 to A/D conversion and having them sequentially read into the microprocesor 100. The output data of these units 101, 102, 103 and 104 are transmitted to the microprocessor 100 through the common bus 150. Numeral 105 designates a power circuit for supplying power to a RAM 107 described later. Numeral 17 designates a battery, and numeral 18 a key switch. The power circuit 105 is connected directly to the battery 17 but not through the key switch 18. As a result the RAM 107 described later is normally impressed with power regardless of the key switch 18. Numeral 106 also designates a power circuit, which in turn is connected to the battery 17 through the key switch 18. The power circuit 106 supplies power to parts other than the RAM 107 described later. Numeral 107 designates a temporary memory unit (RAM) used temporarily during programmed operation. This memory unit provides a non-volatile memory which, normally impressed with power regardless of the key switch 18 as described above, is adapted not to lose the data stored therein even when the key switch 18 is turned off to stop the engine operation. Numeral 108 designates a read-only memory (ROM) for storing a program and various constants. Numeral 109 designates a fuel injection time control counter including a register and a down counter in which a digital signal representing the opening duration of the electromagnetic fuel injection valve 5 computed by the microprocessor (CPU) 100, that is, a fuel injection amount, is converted into a pulse signal representing a pulse duration of actual opening time of the electromagnetic fuel injection valve. Numeral 110 designates a power amplifier for driving the electromagnetic fuel injection valve 5. Numeral 111 designates a timer for measuring the lapse of time and applying the output thereof to the microprocessor 100.

The engine speed counter 101 counts the number of engine r.p.m. once every revolution of the engine, and at the end of count, applied an interrupt command signal to the interrupt control section 102 in response to the output of the speed sensor 15. The interrupt control section 102 thus generates an interrupt signal, and causes the microprocessor 100 to execute an interrupt processing routine for computing the fuel injection amount.

Figure 4:
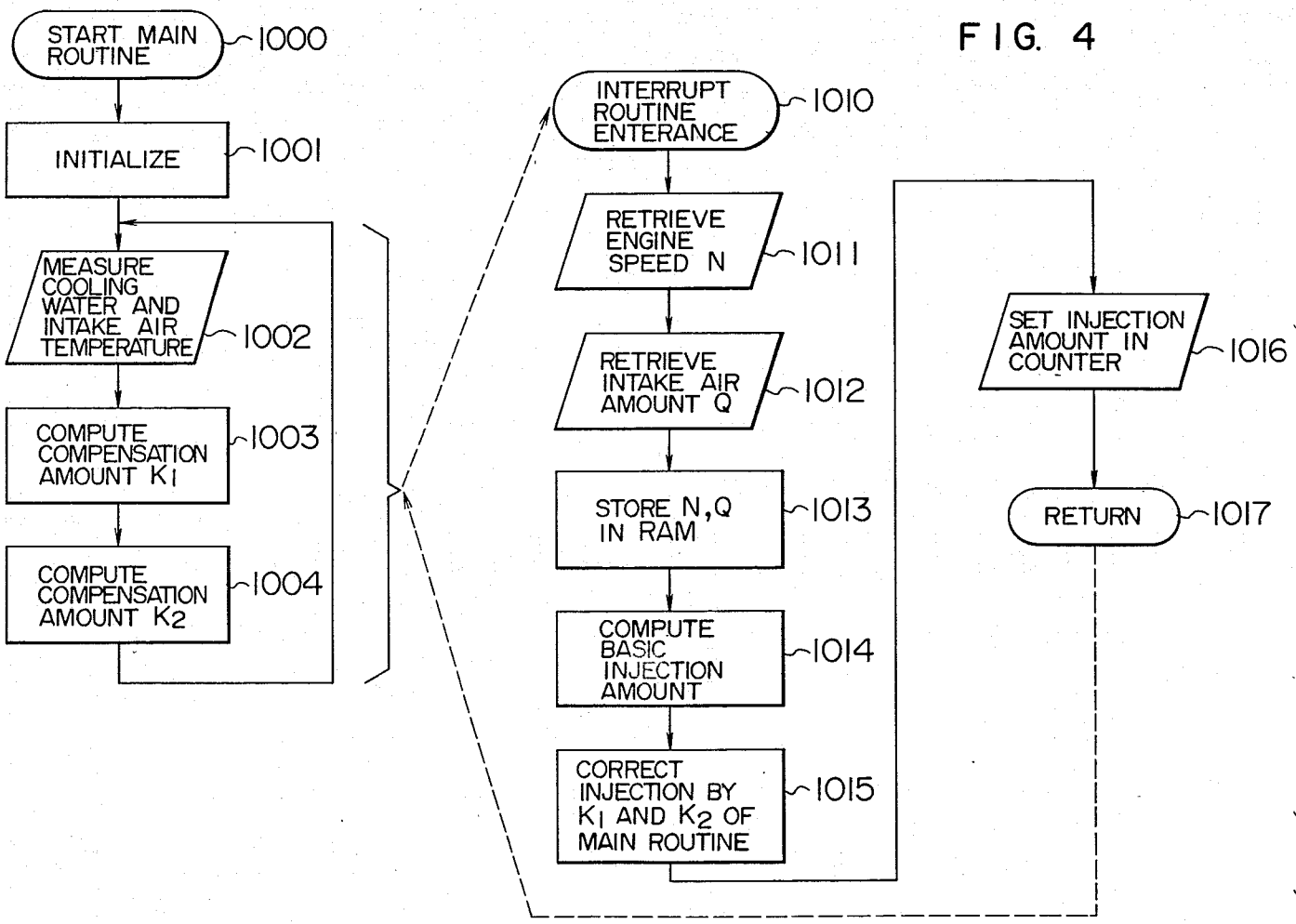
FIG. 4 is a flowchart showing a main routine of a microprocessor.

FIG. 4 schematically shows a flowchart of the microprocessor 100. The functions of the microprocessor 100 and the operation of the whole configuration will be explained with reference to this flowchart. When the engine is started with the key switch 18 and the starter switch 16 turned on, the operation of the main routine is executed at the start of the first step 1000, followed by step 1001 for executing the initialization, and by step 1002 for reading digital values corresponding to the temperatures of cooling water and intake air from the analog input port 104. Step 1003 computes the compensation amount $K_1$ from each compensation value stored in the ROM 108 in accordance with the digital values read, and stores the result thereof in the RAM 107. Step 1004 is supplied with a signal (rich or lean signal) of the oxygen sensor 14 shaped in waveform from the digital input port and a signal of the idel switch 17, and processes the integration characteristics or proportional characteristics in accordance with the duration of the rich and lean signals, the shift (reversion) from rich to lean or lean to rich signal, or idle or non-idle state. The compensation amount $K_2$ thus computed is stored in the RAM 107. After the process of step 1004, the process is returned to step 1002 to execute the same process again.

When an interrupt signal is supplied to the microprocessor 100 from the interrupt control section 102, the process of the main routine is provisionally suspended, and the operation of the interrupt process routine is started at the interrupt process routine entrance of step 1010, so that the present number N of engine r.p.m. is taken at step 1011 and the present intake amount Q taken at step 1012. Step 1013 stores the number N of r.p.m. and the intake air amount Q in the RAM 107, followed by step 1014 in which a basic injection amount Tp ($=Ko\times Q/N$; Ko: Constant) is computed by use of the number N of r.p.m. and the intake air amount Q stored in the RAM 107. Step 1015 compensates the basic injection amount Tp by the compensation amounts $K_1$ and $K_2$ determined in the main routine thereby to compute an injection amount T ($=Tp\times(K_1\times K_2)$) Step 1016 sets this injection amount T in the counter 109, after which step 1017 completes this interrupt process routine and the process is returned to the main routine.

Figure 5:
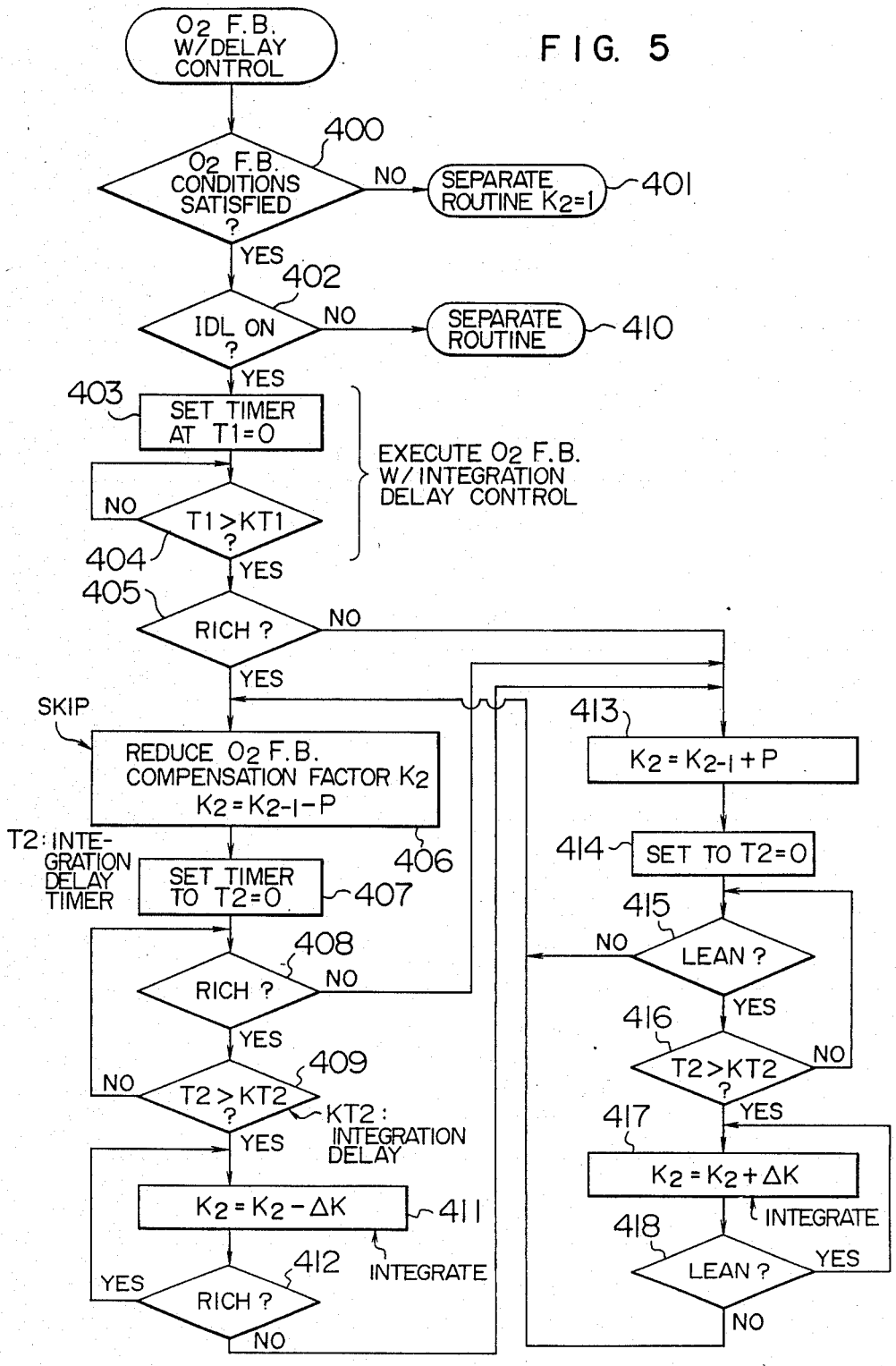
FIG. 5 is a flowchart showing a routine for computing the amount of air-fuel ratio compensation.

The process of computing the compensation amount $K_2$ executed at step 1004 is shown in detail in the program flowchart of FIG. 5. First, step 400 decides whether the oxygen sensor is active and whether the air-fuel ratio is ready for feedback control on the basis of the cooling water temperature, etc. If the feedback control is impossible, that is, if an open loop is determined, the process proceeds to another routine 401 for controlling the compensation amount $K_2$ to 1. If the feedback control is possible, on the other hand, the process proceeds to step 402 for deciding whether the idle switch 17 is on or not. If the idle switch 17 is on, the process proceeds to step 403, while if the idle switch 17 is off, the process proceeds to another routine 410. Step 403 sets the timer to 0, followed by step 404 for deciding whether the value on the timer $T_1$ is greater than $KT_1$ or not. After the it is determined by these steps 403 and 404 whether a predetermined length of time ($KT_1$ seconds) has passed or not after the idle switch 17 was turned on, and if the predetermined length of time has passed, the process proceeds to step 405.

In the separate routine 410, the computation of the compensation amount $K_2$ similar to the conventional process is effected for feedback control of skip and integration type.

Also, step 405 decides whether the signal of the oxygen concentration sensor 14 shaped in waveform at the digital input port 103 is "rich" or "lean" signal, and if it is a "rich" signal, the process proceeds to step 406.

Figure 6:
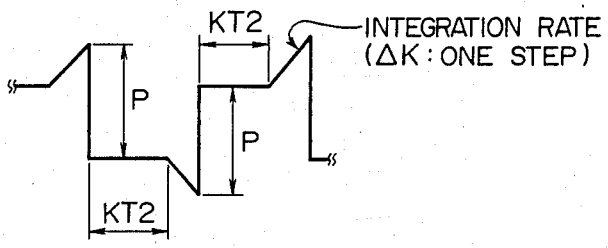
FIGS. 6 and 7 show waveforms of a control signal generated in the air-fuel ratio compensation amount computation routine.
Figure 7:
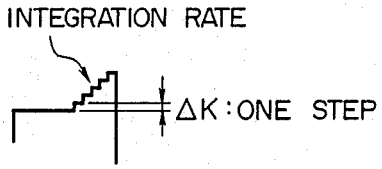

At step 406, the previous compensation amount $K_{2-1}$ is reduced (skipped) by P equivalent to the proportional characteristic, and after the resultant value is stored as a compensation amount $K_2$ in the RAM 107, the process proceeds to step 407. Step 407 sets the timer $T_2$ to zero, followed by step 408 where it is again determined whether the signal from the oxygen sensor 14 is a "rich" or "lean" signal. If step 408 decides that the signal is "rich", the process proceeds to step 409 for deciding whether or not the value on the timer $T_2$ is greater than a predetermined hold time $KT_2$. If it is greater than $KT_2$, the process proceeds to step 411, while if the value is smaller than $KT_2$, the process is returned to step 408. Step 411 reduces the compensation amount $K_2$ by $\Delta K$, and the resultant value is restored as a compensation amount $K_2$ in the RAM 107. The process then is passed to step 412 to decide whether the signal from the oxygen sensor 14 is a "rich" signal again, and if it is decided to be "rich", the process is returned to step 411. As a result, as shown in FIGS. 6 and 7, after skip by the amount equivalent to the proportional characteristic P downward, the compensation amount $K_2$ is held for the hold time $KT_2$. Then, if the signal from the oxygen sensor 14 is "rich", the compensation amount $K_2$ is integrated downward at an integration rate of $\Delta K$.

If any of steps 405, 408 and 412 decides that the signal from the oxygen sensor 14 is "lean", by contrast, the process proceeds to step 413 where the previous compensation amount $K_{2-1}$ is increased (skipped) by an amount equivalent to the proportional characteristics, and the resultant value is stored as a compensation amount $K_2$ in the RAM 107, followed by step 414. Step 414 sets the timer $T_2$ to zero, and step 415 decides whether the signal from the oxygen sensor 14 is "lean" or not. If step 415 decides that the signal is "lean", step 416 decides whether the value on the timer $T_2$ is greater than a predetermined hold time $KT_2$, and if it is greater than $KT_2$, the process proceeds to step 417. If the value is smaller than $KT_2$, on the other hand, the process is returned to step 415. Step 417 increases the compensation amount $K_2$ by $\Delta K$, and the resulting value is stored in the RAM 107, followed by step 418 for deciding whether the signal from the oxygen sensor 14 is "lean". If it is decided that the signal is "lean", the process is returned to step 417. As a result, as shown in FIG. 6 and FIG. 7, after a skip upward by an amount equivalent to the proportional characteristic, the compensation amount $K_2$ is held for a hold time $TK_2$, and then, if the signal from the oxygen sensor 14 is "lean", the compensation amount $K_2$ is integrated upward at an integration rate of $\Delta K$.

In the case where step 415 of 418 decides that the signal from the oxygen sensor 14 is "rich", on the other hand, the process is returned to step 406.

To summarize, if the air-fuel ratio signal from the oxygen sensor 14 shows that the air-fuel ratio is on lean side, the control circuit 20 increases the fuel injection amount, while if the air-fuel ratio signal indicates that the air-fuel ratio is on rich side, an air-fuel ratio feedback control signal is formed to reduce the fuel injection amount. Further, this signal provides different signals in accordance with the on or off condition of the idle switch 17.

Figure 8A:
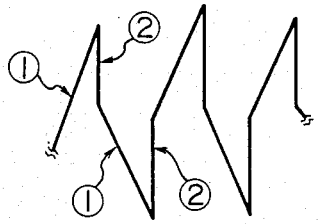
FIGS. 8A and 8B show waveforms representing the air-fuel ratio compensation amount in idle-off and idle-on state respectively.

Specifically, (1) In off-idle state, a conventional compensation amount $K_2$ signal is formed by skip ① and integration ② in accordance with the air-fuel ratio decision signal by a separate routine 410 as shown in FIG. 8A.

Figure 8B:
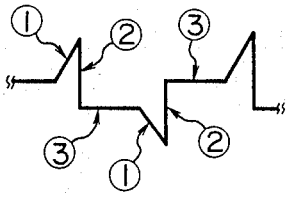

(2) In on-idle state, on the other hand, steps 403 to 409 and steps 411 to 418 form a compensation amount $K_2$ signal by skip ②, holding the value immediately after skip ③ and integration ① as shown in FIG. 8B.

The relationship between the output switching of the compensation amount $K_2$ signal for the air-fuel ratio feedback and the idle switch 17 will be described with reference to FIG. 5. In accordance with the time interrupt routine, the condition of the idle switch 17 is monitored at step 402, so that if the idle switch 17 is off, the process proceeds tot he separate routine 410 thereby to excute the feedback control by skip and integration, while if the idle switch 17 is on, the process is passed to step 403 for deciding whether the switch-on condition continues for a predetermined length of time ($TK_1$ seconds). If the answer is affirmative, the process proceeds to step 405 and so on thereby to perform the feedback control by skip, hold and integration. The value $TK_1$ may be set as desired in accordance with the requirements of the internal combustion engine involved.

Figure 9:
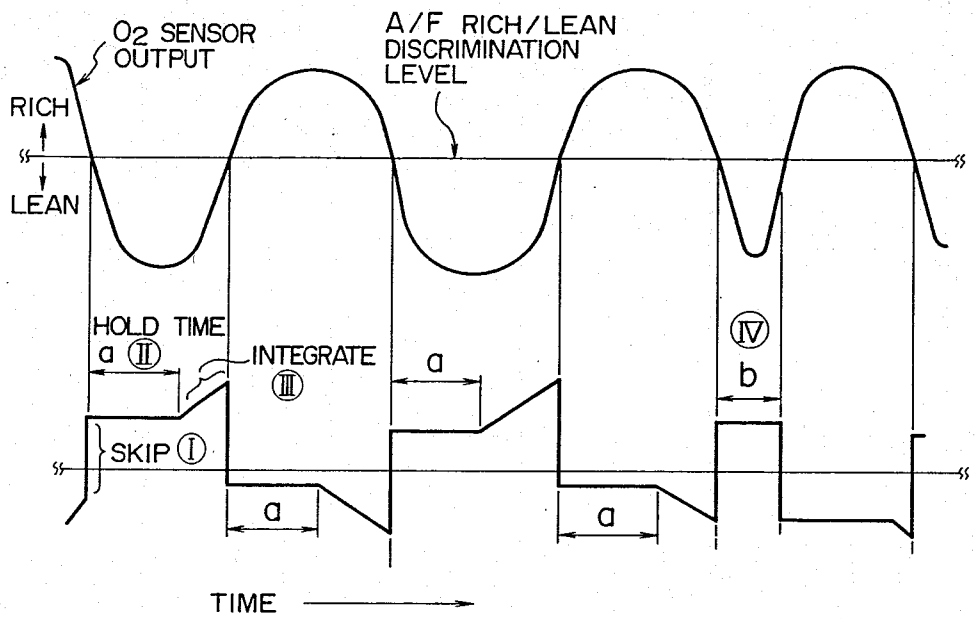
FIGS. 9A and 9B show waveforms of an output signal of an oxygen sensor and an air-fuel ratio feedback signal.

The feedback control by skip, hold and integration will be explained in detail with reference to FIG. 9. FIG. 9(A) shows an output signal waveform of the oxygen sensor 14, and FIG. 9(B) a waveform of an air-fuel ratio feedback control signal when the idle switch 17 is on. When the air-fuel ratio signal shifts from "rich" to "lean" in accordance with the output signal of the oxygen sensor 14, the air-fuel ratio feedback control signal skips a predetermined amount in such a manner as to increase the fuel injection amount, and after the skip, hold the after-skip value for a predetermined period of time a as shown in (II) of FIG. 9(B), thus using the hold value for air-fuel ratio control until the lapse of the predetermined period of time a. After the lapse of the hold time a, the integration of the air-fuel ratio feedback control signal is continued until the air-fuel ratio signal transfers to "rich" side as shown in (III) of FIG. 9(B).

Also when the air-fuel ratio shifts from "lean" to "rich", the process of skip, hold and integration is performed as in the aforementioned case (although the fuel injection amount is reduced instead of increased). The amount of skip and hold time are desirably set to such a value as to shorten the integration process.

In the case where the air-fuel ratio signal crosses the rich/lean decision border during the holding of the after-skip value with the rich/lean states switched (from "rich" to "lean" or from "lean" to "rich"), the air-fuel ratio feedback control signal skips in reverse direction immediately before the lapse of the predetermined length of time in the manner shown in (IV) of FIG. 9(B).

Figure 10:
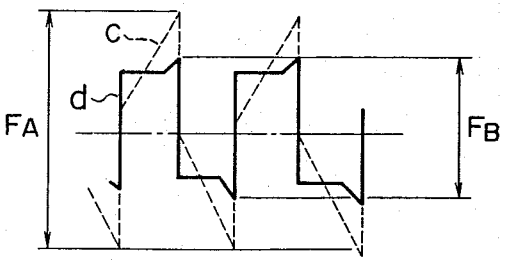
FIG. 10 is a waveform diagram comparing the air-fuel ratio compensation amount according to the present invention with that of the prior art under idle state.

Now, the effect obtained by holding and integrating the integration time during idle state will be explained with reference to FIG. 10. The dashed line c in FIG. 10 indicates a waveform of the air-fuel ratio feedback control signal for skip and integration control, and the solid line d a waveform of the air-fuel ratio feedback control signal for the skip, hold and integration control. Assuming that the control width for the case of dashed line c is $F_A$, the control width $F_B$ for the solid line d may be rendered smaller than $F_A$ by appropriately setting the amount of skip and hold time. If the amount of skip and hold time are set in a manner to reduce the control width this way, the torque variation width of the engine that has so far been subjected to fluctuation with the change in feedback control is dampened, thus improving the idle stability. A satisfactory result was obtained by setting the skip in idle state at 1.2 to 2 times that for non-idle state and the hold time at 0.5 to 2 seconds.

This control method is especially effective for a system with one fuel injection valve 5 arranged upstream of the throttle valve 4 as shown in FIG. 2, as compared with a system in which a fuel injection valve is arranged for each cylinder downstream of the throttle valve 5, in view of the fact that in the former system, a larger time delay occurs from the time of fuel injection from the fuel injection valve to fuel supply to each cylinder.

Figure 12:
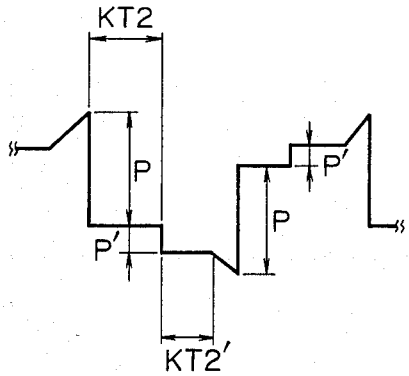
FIG. 12 shows a waveform of a control signal generated in the air-fuel ratio compensation amount computation routine according to another embodiment of the present invention.
Figure 11:
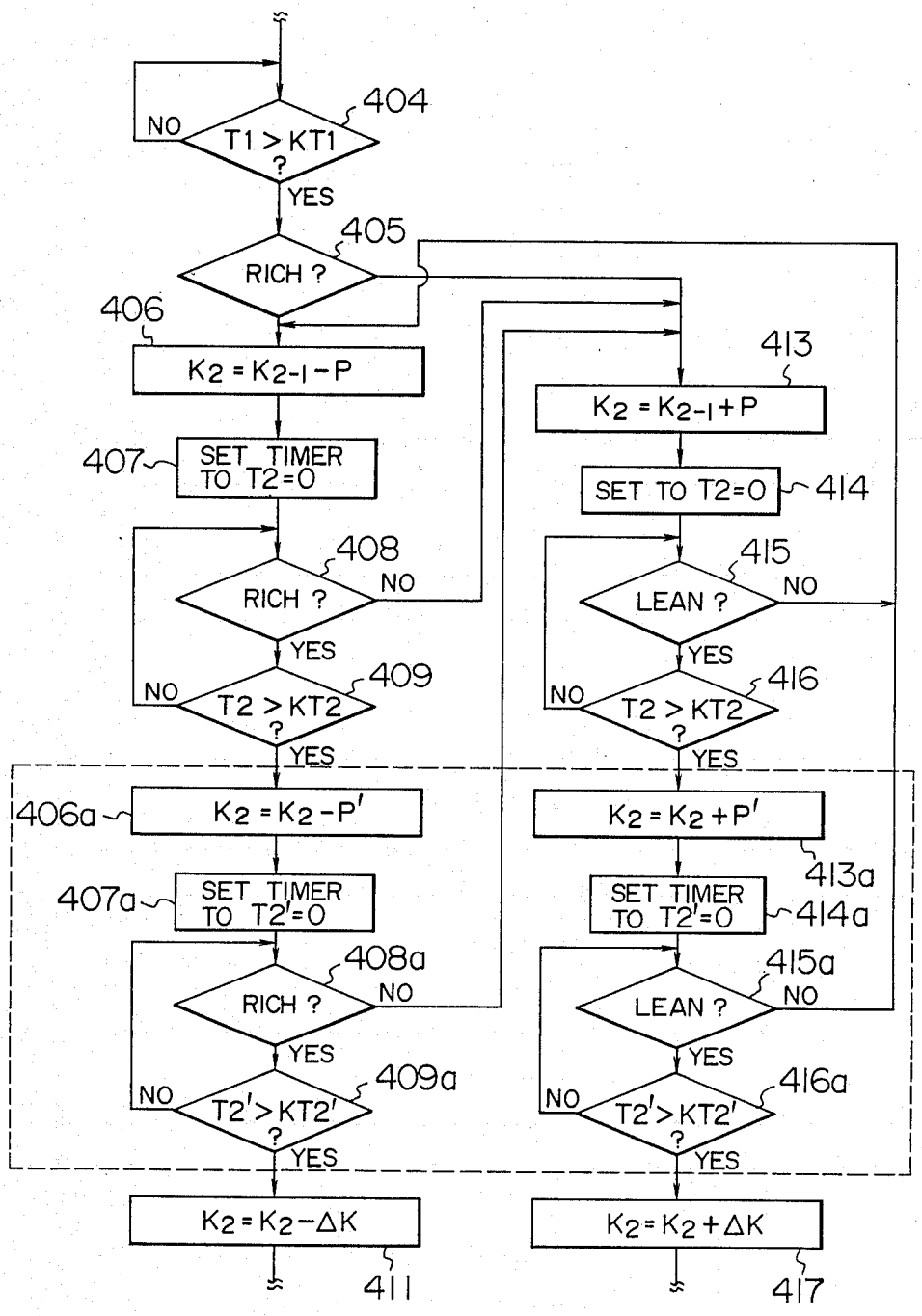
FIG. 11 is a flowchart showing the operation of the essential parts corresponding to FIG. 5 according to another embodiment of the present invention.

Another embodiment of the present invention is shown in FIG. 11 shows another embodiment of the present invention, and includes steps 406*a* to 409*a* and 413*a* to 416*a* in addition to those included in the flowchart of FIG. 5. As shown in FIG. 12, the compensation amount is skipped by P, and the resultant value is held for the length of time $KT_2$, immediately followed by the skip of P'. The value thus obtained is held for the length of time $KT_2'$ followed by integration.

The basic injection amount, which is determined from the amount of intake air in the aforementioned embodiment, may of course obtained in accordance with the intake manifold pressure or throttle valve opening.

It will thus be understood from the foregoing description that according to the present invention, the compensation amount of the air-fuel ratio under idle state is provisionally corrected by being skipped considerably from the compensation amount under non-idle state, and the compensation amount after the skip is held, so that after a predetermined length of time, the compensation amount is integrated thereby to reduce the amplitude thereof. As a consequence, a highly-accurate air-fuel ratio control is realized under idle state, while at the same time dampening the variations in idling.

We claim:

1. An air-fuel ratio control system for an internal combustion engine, comprising:

air-fuel ratio detector means for detecting an air-fuel ratio of the internal combustion engine, idle discriminator means for discriminating whether the internal combustion engine is in an idle state or not, idle air-fuel ratio compensation amount determining means for determining an amount of air-fuel ratio compensation in the idle state in accordance with an output of the air-fuel ratio detector means when the idle discriminator means discriminates the idle state non-idle air-fuel ratio compensation amount determining means for determining the amount of air-fuel ratio compensation in a non-idle stat in accordance with the output of the air-fuel ratio detector means when the idle discriminator means discriminates the non-idle state, and air-fuel ratio feedback means for subjecting the air-fuel ratio of the internal combustion engine to a feedback control in accordance with the air-fuel ratio compensation amount determined by the air-fuel ratio compensation amount determining means;

wherein the idle air-fuel ratio compensation amount determining means includes rich-lean discriminator means for discriminating whether the air-fuel ratio if on the rich or lean side when the output of the idle discriminator means indicates the idling state of the engine, skip means for skipping the air-fuel ratio compensation amount by a degree greater than under the non-idle state when the rich-lean discriminator means determines that the air-fuel ratio has shifted to the lean or rich side, hold means for holding the after-skip compensation amount for a predetermined length of time, and integrator means for integrating the compensation amount after a lapse of the predetermined length of time.

2. An air-fuel ratio control system for an internal combustion engine according to claim 1, wherein the idle air-fuel ratio compensation amount determining means is actuated in place of the non-idle air-fuel ratio compensation amount determining means upon the lapse of the predetermined length of time after the idle discriminator means discriminates the idle state.

3. An air-fuel ratio control system for an internal combustion engine according to claim 1, wherein the idle air-fuel ratio compensation amount determining means skips immediately the compensation amount in a reverse direction through the skip means before the lapse of the predetermined length of holding time when the rich-lean discriminator means determines that the rich or lean state of the air-fuel ratio has changed while the compensation amount after skip by the skip means is held by the hold means.

4. An air-fuel ratio control system for an internal combustion engine according to claim 1, wherein the amount of skip of the skip means is set to a value between 1.2 and 2 times the non-idle skip amount, and the predetermined length of time of the hold means is set for between 0.5 and 2 seconds.

5. An air-fuel ratio control system for an internal combustion engine according to claim 1, wherein the skip means skips the air-fuel ratio compensation amount downward when the rich-lean discriminator means determines that the air-fuel ratio is on the rich side, and skips the air-fuel ratio compensation amount upward when the rich-lean discriminator means determines that the air-fuel ratio is on the lean side.

6. An air-fuel ratio control system for an internal combustion engine according to claim 5, wherein the amount of downward skip of the skip means is equal to the amount of upward skip thereof.

7. An air-fuel ratio control system for an internal combustion engine according to claim 1, wherein the integrator means effects a decremental integration when the air-fuel ratio is on the rich side, and an incremental integration when the air-fuel ratio is on the lean side.

8. An air-fuel ratio control system for an internal combustion engine according to claim 7, wherein the rate of the decremental integration of the integrator means is equal to the rate of the incremental integration thereof.

9. An air-fuel ratio control system for an internal combustion engine according to claim 1, wherein the rate of the integration of said integrator means is constant.

10. An air-fuel ratio control system for an internal combustion engine according to claim 1, wherein said idle air-fuel ratio compensation amount determining means causes the skip means to skip the compensation amount in reverse direction immediately when the rich-lean discriminator means decides that the air-fuel ratio has shifted from the rich to lean side or the opposite way during the integration by the integrator means.

11. An air-fuel ratio control system for an internal combustion engine according to claim 1, wherein the skip means skips the compensation amount in two steps, the hold means holding the compensation amount after the first step of skip for a first predetermined length of time and the compensation amount after the second step of skip for a second predetermined length of time.

12. An air-fuel ratio control system for an internal combustion engine, comprising:

air fuel ratio detector means for detecting an air-fuel ratio of the internal combustion engine, rich-lean discriminator means for discriminating whether the air-fuel ratio is on the rich or lean side in accordance with an output of the air-fuel ratio detector means, idle discriminator means for discriminating whether the internal combustion engine is in an idle state or not, non-idle air-fuel ratio compensation amount determining means for determining an amount of air-fuel ratio compensation under the non-idle state, which includes skip and integration, in accordance with the output of the air-fuel ratio detector means when the idle discriminator means discriminates the non-idle state, idle air-fuel ratio compensation amount determining means for determining the amount of air-fuel ratio compensation under the idle state in accordance with the output of the air-fuel ratio detector means when the idle discriminator means discriminates the idle state, and including skip means for skipping the air-fuel ratio compensation amount by a degree greater than under the non-idle state when the rich-lean discriminator means discriminates that the air-fuel ratio has shifted to the lean side from the rich side or that the opposite has occurred, hold means for holding the after-skip compensation amount for a predetermined length of time, integrator means for integrating the compensation amount after a lapse of the predetermined length of time, and air-fuel ratio feedback means for controlling the air-fuel ratio of the internal combustion engine in accordance with the air-fuel ratio compensation amount determined by the non-idle air-fuel ratio compensation amount determining means or the idle air-fuel ratio compensation amount determining means.

13. A method of feedback controlling an air-fuel ratio of an internal combustion engine, comprising the steps of:

(a) detecting an air-fuel ratio of the internal combustion engine, (b) discriminating whether the detected air-fuel ratio is rich or lean, (c) discriminating whether the internal combustion engine is in an idle state or not, (d) determining an amount of air-fuel ratio compensation under the non-idle state which includes skip and integration in accordance with the air-fuel ratio detected in the step (a) when the step (c) discriminates that the internal combustion engine is in the non-idle state, (e) determining an amount of air-fuel ratio compensation under the idle state when the step (c) discriminates that the internal combustion engine is in the idle state, including a step of skipping the air-fuel ratio compensation amount by a degree greater than under the non-idle state when the step (b) discriminates that the air-fuel ratio has shifted to the lean side from the rich side or the opposite, a step of holding the after-skip compensation amount for a predetermined length of time, a step of integrating the compensation amount after a lapse of the predetermined length of time, and a step of integrating the compensation amount after a lapse of the predetermined length of time, and (f) feedback controlling the air-fuel ratio of the internal combustion engine in accordance with the air-fuel ratio compensation amount determined by either one of the steps (d) and (e).

14. A method according to claim 13, wherein the step (e) is carried out instead of the step (d) after a lapse of a predetermined length of time when the idle state is discriminated in the step (c).

15. A method according to claim 13, wherein when discriminating a change of the state of the rich or lean during a term of holding a compensation amount after skipping, the skip in reverse is carried out immediately without waiting the lapse of the predetermined time to be held, in the step (e).

* * * * *